United States Patent [19]

Young et al.

[11] 4,441,897

[45] Apr. 10, 1984

[54] WET ELECTROSTATIC PRECIPITATOR HAVING REMOVABLE NESTED HEXAGONAL COLLECTOR PLATES AND MAGNETIC ALIGNING AND RAPPING MEANS

[75] Inventors: Charles E. Young; George Drzewiecki, both of Ontario, Canada

[73] Assignee: Inco Limited, Toronto, Canada

[21] Appl. No.: 348,221

[22] Filed: Feb. 12, 1982

[30] Foreign Application Priority Data

Sep. 30, 1981 [CA] Canada ..... 386980

[51] Int. Cl.[3] ..... B03C 3/76

[52] U.S. Cl. ..... 55/112; 55/118; 55/148; 55/151; 55/156

[58] Field of Search ..... 55/13, 112, 118, 119, 55/120, 140, 147, 148, 151, 156

[56] References Cited

U.S. PATENT DOCUMENTS

| | | | |
|---|---|---|---|
| 2,443,780 | 6/1948 | Wintermate | 55/118 |
| 2,506,402 | 5/1950 | Wintermate | 55/119 |
| 2,508,133 | 5/1950 | Anderson | 55/112 |
| 2,555,216 | 5/1951 | Wintermate . | |
| 2,672,207 | 3/1954 | Hedberg . | |
| 2,814,356 | 11/1957 | Wintermate | 55/112 |
| 2,853,150 | 9/1958 | Lenehan | 55/118 |
| 3,485,011 | 12/1969 | Archer et al. | 55/147 |
| 3,988,131 | 10/1976 | Kanazawa . | |

FOREIGN PATENT DOCUMENTS

| | | | |
|---|---|---|---|
| 1038306 | 9/1978 | Canada . | |
| 701416 | 12/1940 | Fed. Rep. of Germany . | |
| 811950 | 6/1951 | Fed. Rep. of Germany . | |
| 380890 | 9/1932 | United Kingdom . | |
| 728185 | 4/1955 | United Kingdom | 55/120 |

*Primary Examiner*—Bernard Nozick

*Attorney, Agent, or Firm*—Edward A. Steen; Raymond J. Kenny

[57] ABSTRACT

A wet electrostatic precipitator (10) including a plurality of removable nested collecting electrodes or plates (36) forming a repeating pattern of hexagonal collecting zones (44) throughout the precipitator (10). Each collecting plate (36) is formed with a sixty degree bend along two opposing longitudinal edges so as to allow three plates (36) to form a self-nesting Y-shaped intersection point (46). Six points (46) form a hexagonal collecting zone (44). The plates (36) are removable thereby expediting replacement. A plurality of strategically placed spray nozzles (34) provide wash fluid to the plates (36). Magnet sets (56 and 58) provide for discharge electrode (18 and 18A) alignment and rapping.

11 Claims, 10 Drawing Figures

WET ELECTROSTATIC PRECIPITATOR HAVING REMOVABLE NESTED HEXAGONAL COLLECTOR PLATES AND MAGNETIC ALIGNING AND RAPPING MEANS

TECHNICAL FIELD

This invention relates to the art of pollution control in general and more particularly to electrostatic precipitators.

BACKGROUND ART

It has been long known that by passing a particulate laden gas stream through an intense electrostatic field a large quantity of the entrained particulate matter may be ionized and stripped from the gas stream and deposited onto an oppositely charged surface. Indeed, Cottrell received his first patent (U.S. Pat. No. 895,729) directed to an electrostatic precipitator in 1908.

Briefly, there are two types of electrostatic precipitators in common use. Dry electrostatic precipitators ionize the particles which are then collected on a grounded plate. The particles are removed by a rapping mechanism which dislodges the particles from the collecting surface. A wet electrostatic precipitator operates on the same principle as the dry device. However, the dust particles collected on the grounded tube are removed therefrom by a film of wash liquid which is passed over the tube. Collector plates having various configurations have been suggested over the years, the most common being tubular and straight sided.

Electrostatic precipitators may be further classified into single stage units wherein the ionization and collection processes occur simultaneously and two-stage precipitators wherein ionization occurs in one section of the unit and collection occurs in an adjacent section of the unit.

Most conventional tube-type wet precipitators include a plurality of positively charged discharge electrode (or corona) wires circumscribed by an equal number of spaced, negatively charged tubular collecting electrodes. The tubes are fixed to an upper tube header and a lower tube header. The discharge electrodes are suspended from an upper frame extending through the tubes and are kept in alignment by a lower frame. Some designs call for the lower frame to be supported by a number of "stiff-legs" fixedly extending from the upper frame. In some embodiments, an oversized tube circumscribes the leg; the leg in this instance doubling as a discharge electrode. In this particular configuration, a plurality of corona needles normally extend from the electrode. In any event, the "stiff-legs" prevent the discharge electrodes from drifting towards the collecting tubes and disrupting the delicate coaxial symmetry necessary. Hexagonal wet precipitators, hung in a relatively similar manner, utilize welded straight segments to comprise the collecting electrodes. A cleaning fluid (usually water) is introduced above the upper header via a plurality of carefully leveled and monitored irrigation ponds and weirs to cause a liquid film to flow down the inner surfaces of the collecting electrodes.

Due to the operating characteristics of a wet electrostatic precipitator, the collecting electrodes (in addition to the other internal components) are subject to debilitating corrosion which oftentimes necessitates the repair and eventual replacement of the damaged electrodes. It goes without saying that the replacement of collecting electrodes, which are usually welded to the upper and lower tube headers, is a difficult and expensive undertaking. Moreover, tubular electrodes no matter how closely packed, require a finite deadspace between the tubes. This deadspace effectively reduces the internal particulate collecting surface area. Finally, it is difficult to maintain the proper water level in the irrigation ponds and weirs to adequately ensure a metered supply of wash fluid to the electrodes.

SUMMARY OF THE INVENTION

There is provided a wet electrostatic precipitator having removably nested collector plates arranged in a honeycomb pattern about the discharge electrodes. Opposing longitudinal edges of each plate are bent to enable six plates to form a hexagonal collecting zone. The zones extend throughout the precipitator. This arrangement provides for the maximum amount of collector surface area possible while completely eliminating deadspace. Due to this configuration, the individual plates need not be welded. Instead, they are demountably hung from the tube sheet to facilitate removal from the precipitator should the need arise.

Disposed beneath the tube sheet and above the collecting plates are a plurality of spray nozzles for washing the plates of accumulated particulate matter.

The lower high voltage frame is coaxially aligned and restrained against excessive lateral movement by a number of magnets arranged about the frame and the precipitator shell. The magnets may also be utilized to rap the discharge electrodes.

PREFERRED MODE FOR CARRYING OUT THE INVENTION

Figure 1:
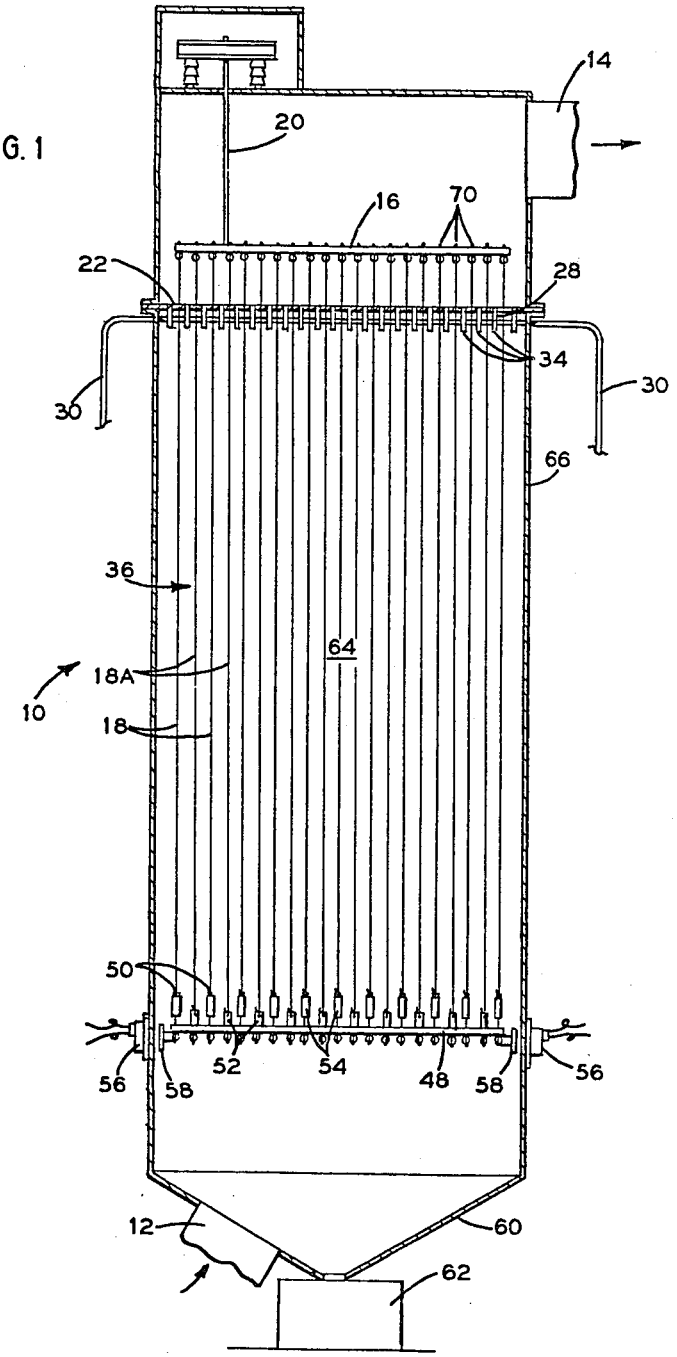
FIG. 1 is a cross-sectional elevation of an electrostatic precipitator.

Referring to FIG. 1, there is shown a wet electrostatic precipitator 10 (hereinafter "ESP") having shell 66, gas inlet 12, gas outlet 14, effluent hopper 60 and effluent tank 62. Upper high voltage frame 16, having a plurality of discharge or corona electrodes 18 and 18A depending therefrom, is suspended from the ESP's high voltage insulators by a plurality of high voltage bars 20 (only one is shown). Each bar 20 is electrically connected to standard ESP circuitry (not shown) in a manner known in the art.

Figure 3:
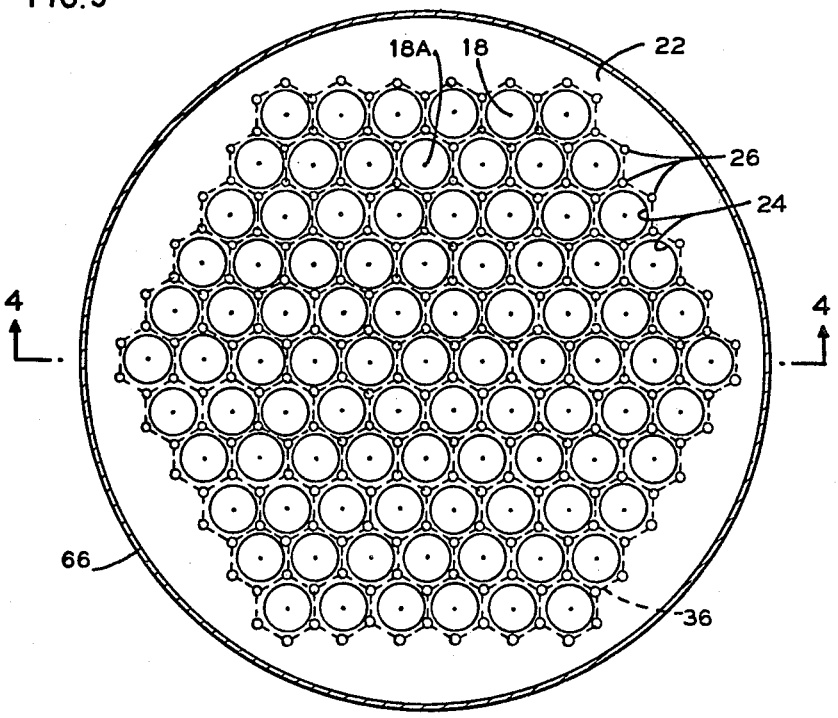
FIG. 3 is a plan view of a tube sheet.
Figure 4:
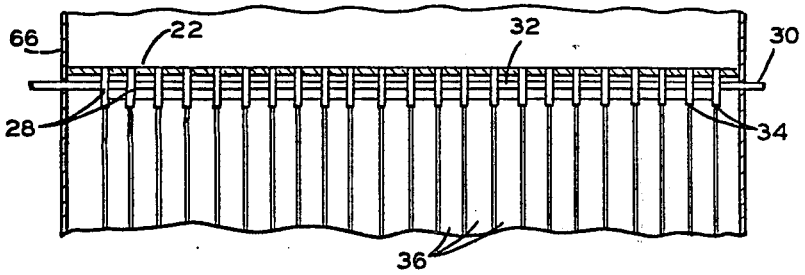
FIG. 4 is a view taken along line 4—4 in FIG. 3.

Disposed beneath the frame 16 is a tube sheet 22. See especially FIGS. 3, 4 and 7. Referring to FIG. 3, the sheet 22 includes two sets of dissimilarly sized apertures. Large diameter holes 24, accommodate the discharge electrodes 18 and 18A. Small diameter holes 26 serve as mounting wells for a plurality of depending fluid spray carrier tubes 28. Returning to FIG. 1, fluid line 30 supplies the washing fluid to spray nozzles 34 via the carrier tubes 28 and fluid channels 32. For more detail, see FIGS. 6, 7 and 8.

Figure 6:
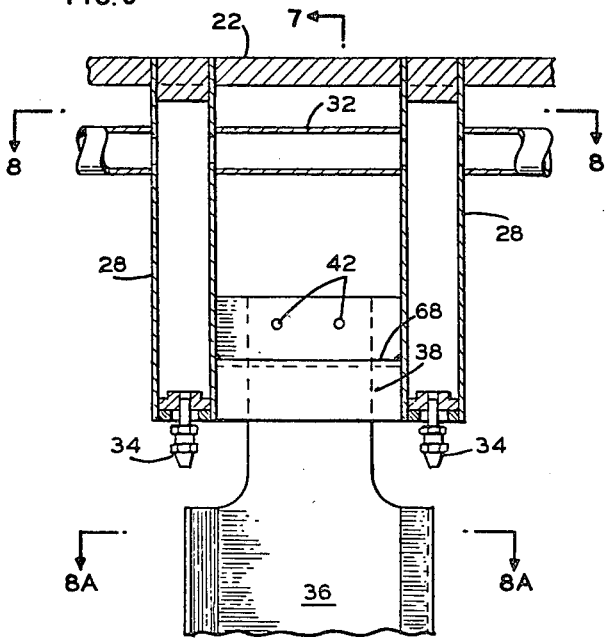
FIG. 6 is a cross-sectional view of the electrostatic precipitator.
Figure 7:
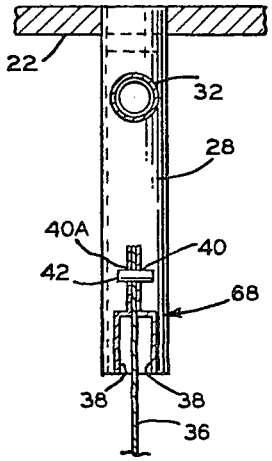
FIG. 7 is a view taken along line 7—7 in FIG. 6.

A plurality of collector electrodes supported by plates 36 the sheet 22 between the tubes 28. Referring briefly to FIGS. 6 and 7, two complimentary angles 38, each provided with apertures 40, are fixed between the tubes 28 to form a plate supporting structure or hanger 68 for each collecting plate 36. The electrode 36, which is fashioned with a pair of apertures 40A, is inserted between the two angles 38 so as to align the apertures 40 and 40A. A removable pin 42 is inserted into the apertures 40 and 40A to uphold the plate 36. Other non-permanent mounting methods may be employed as well.

Figure 5:
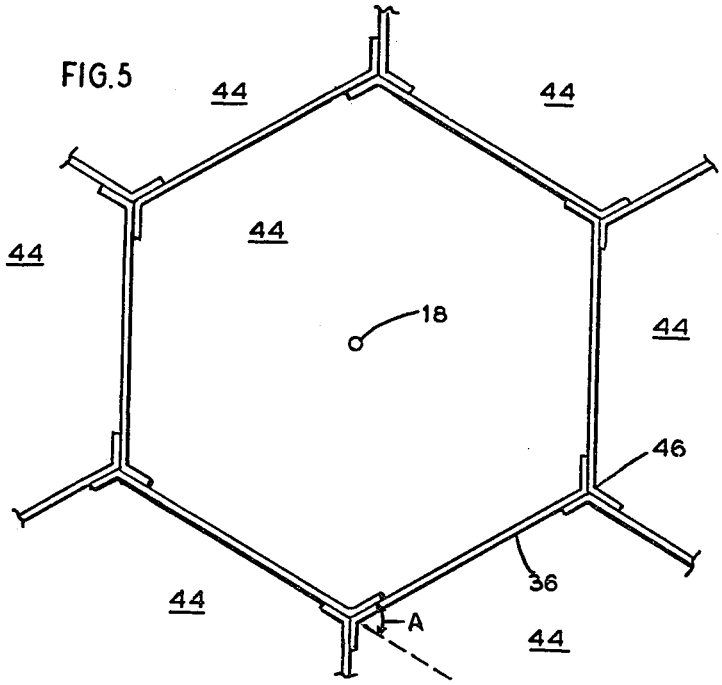
FIG. 5 is a plan view of the nested collecting electrodes.
Figure 8A:
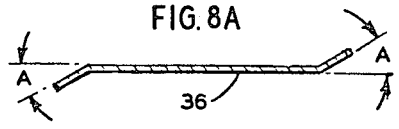
FIG. 8A is a view taken along line 8A—8A in FIG. 6.
Figure 8:
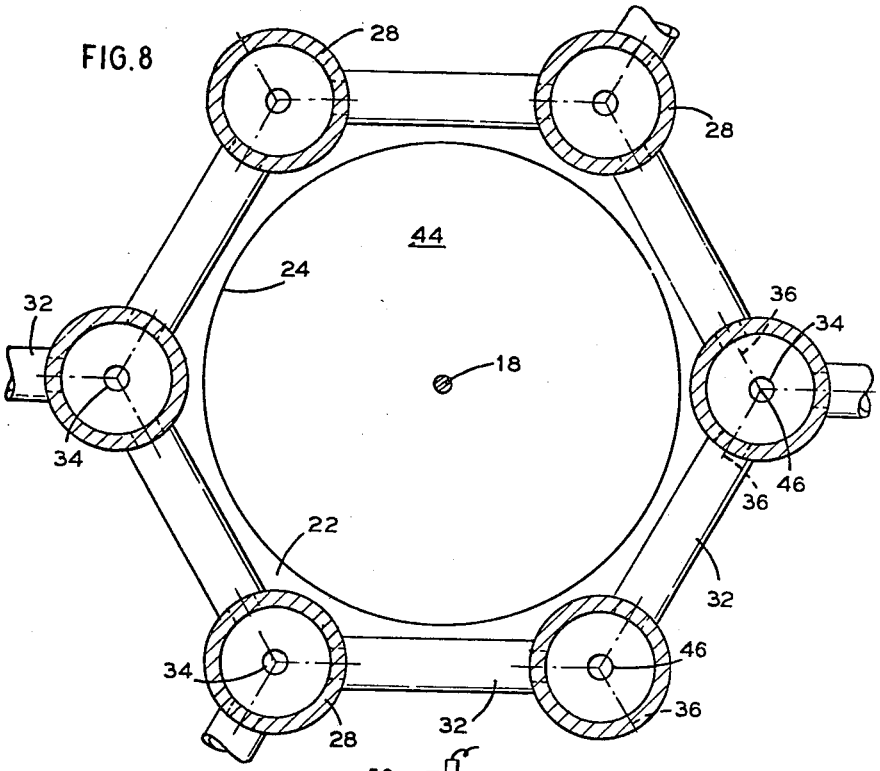
FIG. 8 is a view taken along line 8—8 in FIG. 6.

As can be seen most clearly in FIGS. 3, 5 and 8, the plates 36 are nested together to form a plurality of individual hexagonal or honeycombed collecting zones 44. The plates 36 are formed with two sixty-degree bends (designated "A") along each longitudinal edge. Each plate 36 is hung between the tubes 28 in such an equiangled fashion as to form a single Y-shaped intersection point 46 with two of its neighbors. By virtue of the physical geometry of the plates 36, six interconnected points 46 will form a single hexagonal zone 44. Note that the plates need not be welded to one another. Indeed, solely due to their specific orientation and sheer dead weight, the numerous nested and interconnected plates 36 form a repeating, yet rigid, honeycombed zone 44 pattern throughout the ESP. It should be further appreciated that contrary to tubular designs, this embodiment generates no deadspace. Both sides of each plate 36 are utilized to collect particulate matter. Moreover, contrary to welded straight sided configurations, each plate 36 is easily removable. Thus, there is no need to cut out the sound plates to remove the defective ones.

The honeycombed tube bundle 64, consisting of the zones 44, extends downwardly throughout most of the ESP and ends above lower frame 48.

Figure 2:
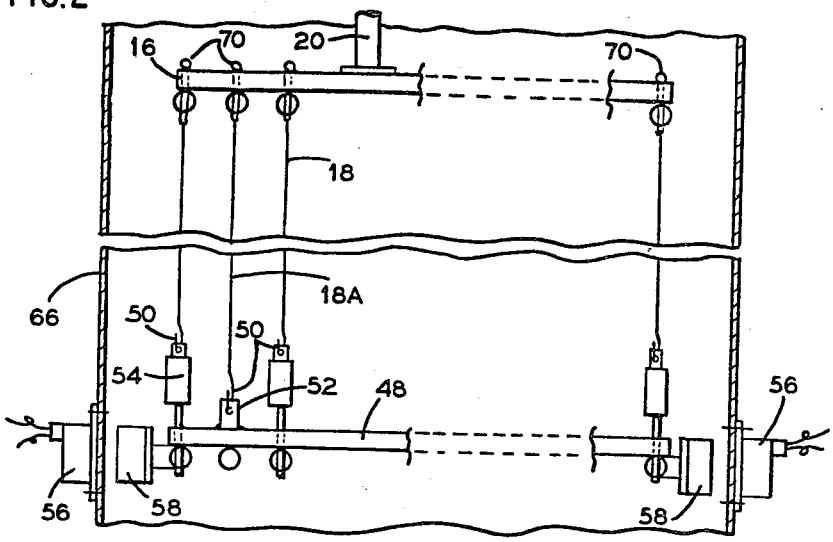
FIG. 2 is a partial elevation of the electrostatic precipitator.

Turning now to FIG. 2, the lower frame 48 is floatably suspended from the top frame 16 by a number of loadbearing discharge electrodes 18A. Each electrode 18 and 18A is equipped with a hook 50. The loadbearing electrodes 18A are fitted through gusset 52 which in turn is attached to the lower frame 48. The nonloadbearing electrodes 18 are hooked to weights 54, which in turn are slidably registered to the frame 48. The two aforementioned hooking configurations align the electrodes 18 and 18A while simultaneously maintaining proper electrode tautness.

The electrodes 18 and 18A may be attached to the upper frame 16 in any known manner. Inorder to expedite electrode 18 and 18A removal, a demountably affixed nut 70 may be utilized to hold the electrodes in place.

Figure 9:
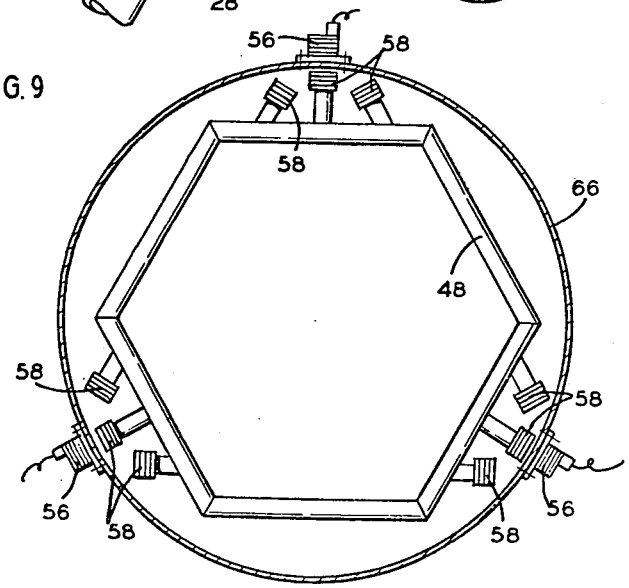
FIG. 9 is a plan view of the electrostatic precipitator.

A number of spaced electromagnets 56 are disposed about the shell 66 of the ESP whereas a plurality of permanent magnets 58 are attached to the frame 48. As will be explained shortly, the magnetic sets 56 and 58 are utilized to rap the electrodes 18 and 18A and to maintain the alignment of the electrodes 18 and 18A. See FIGS. 2 and 9.

FIG. 8 depicts an arrangement for the fluid channels 32. A spray tube/nozzle combination 28 and 34 is situated over every plate intersection 46 just below the tube sheet 22. The placement of the nozzles 34 immediately above the intersections 46 provides for direct and optimum washdown capability without the need for weirs and ponds. Note further how the plates 36 are arranged with their neighboring plates to form each zone 44.

FIG. 8A depicts the orientation of single plate 36.

The invention and the manner of applying it may perhaps be better understood by a brief discussion of the principles underlying the invention.

Briefly, a particulate entrained gas stream is introduced to the ESP via the duct 12. The gas stream flows upwardly through the tube bundle 64. The discharge electrodes 18 and 18A are positively charged whereas the collector plates 36 and negatively charged. Potentials of 60,000 volts or more may be employed. Due to the physical dimensions of the thin discharge electrodes 18 and 18A, the plates 36, and the high voltage, an intense electrostatic field is set up within each zone 44. The particles are ionized, that is stripped of their electrons, and become positively charged. As the ionized particles continue to flow upwardly through the ESP, they are steadily drawn to the negatively charged plates 36. The ionizing/cleansing processes continue as the gas rises through the ESP until it exists the unit via the duct 14 substantially stripped of all particulate matter.

Inasmuch as the instant invention utilizes a honeycombed plate configuration, the particles are presented with a large collecting surface area. Indeed, both sides of each plate 36 are utilized to strip the entrained particulates from the gas stream. Contrast this state of affairs with a round tube ESP. The inherent deadspace present in the round tube design effectively robs this type of ESP of valuable collecting surface area.

The plates 36 are more densely packed together than is possible in an arcuate design. This closeness of plates provides the ESP with a greater number of collecting plates per given area. Moreover, by sharing adjacent plates, the instant design results in a smaller sized precipitator. As a direct result, savings are appreciated since there is less of a need for expensive alloyed materials in the make-up of the ESP.

It is preferred to form the plates from thin gauge stainless steel with the opposing longitudinal edges bent over sixty degrees to allow a nesting fit with an adjacent plate. Inasmuch as they are not welded together, the nesting arrangement allows for the quick replacement of defective or damaged collector plates.

In order to effect plate 36 replacement, the pins 42 are removed from the apertures 40 and 40A to free the targeted plate. The plate is then dropped and removed from the interior of the ESP via conveniently located access doors (not shown).

Due to the geometry and location of the nozzles 34 positioned below the tube sheet 22 but above the intersections 46, the plates 36 are effectively bathed by a fluid spray. The resulting downward flow of wash fluid carries with it the charged particles previously clinging to the plates 36 to the hopper 60 and eventually to the tank 62. If desired, the nozzles may be easily replaced.

During operation of the ESP, the various internal components experience forces that may tend to misalign the discharge wires 18 and 18A. Accordingly, the lower frame 48 is coaxially aligned and restrained against excessive lateral movement by the magnet sets 56 and 58. By varying the current supplied to the various electromagnets 56, a large degree of optimum alignment control may be exercised which has been hitherto unavailable. In a sense, the alignment may be "fine tuned" to close tolerances.

It is preferred to employ a cluster of the permanent magnets 58 centered about the magnets 56 to "lock" the tube bundle 64 and prevent it from moving when the precipitator 10 is energized.

Moreover, the magnet sets 56 and 58 permit vibratory rapping of the discharge wires 18 and 18A. In some instances the wires may also become caked with particulate matter. In order to maintain optimum ESP efficiency, it is necessary to periodically clean the wires. This is accomplished by rapidly switching the magnets on and off. As a consequence, vibratory patterns will be set up in the discharge wires thereby releasing the accumulated undesirable buildup.

While in accordance with the provisions of the statue, there is illustrated and described herein specific embodiments of the invention. Those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. An electrostatic precipitator, the precipitator comprising a shell, gas inlet and outlet ducts in fluid flow communication with the shell, a plurality of discharge electrodes and collecting electrodes disposed within the shell, an upperframe for suspending the discharge electrodes within the shell, the upper frame insulatingly supported by the shell, a lower frame supported from the upper frame by at least some of the discharge electrodes, means for supporting the collecting electrodes, a plurality of fluid sprayers disposed above the collecting electrodes, the collecting electrodes forming a honeycombed pattern of repeating, hexagonal collecting zones within the precipitator, the collecting electrodes including a plurality of long plates having two opposing sixty degree bends formed along the two longitudinal edges of each plate, each bent edge of each plate registered with two similar longitudinal edges from two similarly formed adjacent collecting electrodes to form a self-nesting, equiangled, Y-shaped intersection point and the resultant honeycombed pattern of repeating, hexagonal collecting electrodes throughout the precipitator, and a discharge electrode disposed within each collecting electrode.

2. The precipitator according to claim 1 wherein a fluid sprayer is disposed above an equiangled Y-shaped intersection point.

3. The precipitator according to claim 1 wherein a predetermined number of the discharge electrodes suspend the lower frame within the shell, and the remaining discharge electrodes are in contact with the lower frame.

4. The precipitator according to claim 1 wherein a tube sheet is disposed between the upper and lower frames for supporting the collecting electrodes and the fluid sprayers.

5. The precipitator according to claim 4 wherein a plurality of interconnected fluid channels are disposed below the tube sheet, a plurality of fluid tubes are in fluid flow communication with the fluid channels and the sprayers, and the sprayers are disposed above the equiangled Y-shaped intersection points.

6. The precipitator according to claim 5 wherein the tube sheet includes a plurality of first apertures to support the tubes and a plurality of second apertures to permit gas flow therethrough.

7. The precipitator according to claim 5 wherein the collector plates defining the collector electrodes are detachably suspended between the fluid tubes.

8. The precipitator according to claim 5 wherein a plate hanger is affixed between two fluid tubes and each plate is detachably suspended from the hanger.

9. The precipitator according to claim 1 wherein a plurality of first magnets are affixed to the lower frame and a plurality of second magnets are spaced away from the first magnets by a predetermined distance to effect electrode alignment and rapping thereof.

10. The precipitator according to claim 9 wherein the second magnets are affixed to the shell.

11. The precipitator according to claim 9 wherein the first magnets are permanent magnets and the second magnets are electromagnets.

* * * * *